US007049563B2

(12) United States Patent
Keishima et al.

(10) Patent No.: US 7,049,563 B2
(45) Date of Patent: May 23, 2006

(54) INDUCTION COOKER WITH HEATING COIL AND ELECTRICAL CONDUCTOR

(75) Inventors: Toshihiro Keishima, Kobe (JP); Akira Kataoka, Sanda (JP); Izuo Hirota, Toyonaka (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/515,570

(22) PCT Filed: May 24, 2004

(86) PCT No.: PCT/JP2004/007409

§ 371 (c)(1),
(2), (4) Date: Nov. 23, 2004

(87) PCT Pub. No.: WO2005/006813

PCT Pub. Date: Jan. 20, 2005

(65) Prior Publication Data

US 2005/0205561 A1 Sep. 22, 2005

(30) Foreign Application Priority Data

Jul. 15, 2003 (JP) ..... 2003-197139

(51) Int. Cl.
*H05B 6/12* (2006.01)

(52) U.S. Cl. ..... 219/620; 219/621; 219/624; 219/675

(58) Field of Classification Search ..... 219/620–624, 219/670–677; 99/DIG. 14
See application file for complete search history.

(56) References Cited

U.S. PATENT DOCUMENTS 4,220,839 A * 9/1980 De Leon ..... 219/638

FOREIGN PATENT DOCUMENTS

| | | | |
|---|---|---|---|
| EP | 1 437 920 A1 | | 7/2004 |
| JP | 50-82046 | | 7/1975 |
| JP | 52-14944 | | 2/1977 |
| JP | 61-169988 U | | 10/1986 |
| JP | 2-242582 A | | 9/1990 |
| JP | 7-211443 | * | 8/1995 |
| JP | 7-211443 A | | 8/1995 |
| JP | 7-211444 A | | 8/1995 |
| JP | 7-249480 A | | 9/1995 |
| JP | 3465711 B2 | | 8/2003 |
| JP | 3465712 B2 | | 8/2003 |
| JP | 2003-264054 A | | 9/2003 |

* cited by examiner

*Primary Examiner*—Philip H. Leung

(57) ABSTRACT

An electric conductor provided for decreasing a lifting force exerted on an object being heated has an aperture of a small diameter in the center thereof, which leaves a large surface area to enhance reduction of the lifting force. The electric conductor is also provided with a comb section around the aperture for preventing a circling current induced in the electric conductor from flowing into an area around the aperture. This structure can thus alleviate excessive heating around the aperture, and allow the heating coil to produce a high output power for a long duration of time even when an inwardly concaved pan is used.

15 Claims, 4 Drawing Sheets

INDUCTION COOKER WITH HEATING COIL AND ELECTRICAL CONDUCTOR

This application is a U.S. national phase application of PCT international application PCT/JP2004/007409.

TECHNICAL FIELD

The present invention relates to an induction heating apparatus such as an induction cooking stove for cooking food by using a pan made of a material of high electrical conductivity and low magnetic permeability such as aluminum and copper as an object to be heated. In particular, this invention relates to the induction heating apparatus that prevents the pan or the object to be heated from being lifted by the effect of high-frequency magnetic flux.

BACKGROUND ART

Among induction cooking stoves that produce high-frequency magnetic field with an induction heating coil for heating an object to be heated such as a pan with eddy current generated by the electromagnetic induction, there have been proposed certain types that can heat objects made of aluminum.

FIG. 4 is a cross sectional view of a conventional induction cooking stove. Top plate 2 is mounted to an upper part of main body 1 that composes an enclosure of the induction cooking stove. Top plate 2 is constructed of an insulating material such as ceramic and crystallized glass having a thickness of 4 mm, for instance. Utensil 3 to be heated such as a pan is placed on top plate 2. Induction heating unit 5 having heating coil (hereinafter referred to as "coil") 4 is provided underneath top plate 2. Driving circuit 6 including an inverter supplies a high-frequency current to coil 4, which in turn generates high-frequency magnetic field to heat utensil 3 by magnetic induction.

In the conventional induction cooking stove of this type, an interaction between an electric current induced in the bottom of utensil 3 and the magnetic field generated by coil 4 produces a repulsive force on the bottom of utensil 3 in a direction of pushing utensil 3 away from coil 4. This repulsive force is comparatively small when utensil 3 is made of a material of high magnetic permeability and relatively large specific resistance such as iron, since it requires a small electric current to obtain the desired output of heating power. In addition, utensil 3 made of iron and the like does not move upward or sideways since it receives a magneto-attractive force as it absorbs the magnetic flux.

On the other hand, if utensil 3 to be heated is made of a material of high conductivity and low magnetic permeability such as aluminum and copper, coil 4 requires a large current to induce a large current in the bottom of utensil 3 in order to obtain the desired output of heating power. Consequently, this produces a large repulsive force. In addition, utensil 3 made of aluminum does not receive as large a magneto-attractive force as in the case of the material of high magnetic permeability such as iron. As a result, an interaction between the magnetic field of coil 4 and another magnetic field generated by an induced current in utensil 3 produces a large force in the direction of pushing the utensil 3 away from coil 4. This force acts upon utensil 3 as a lifting force. There is a possibility that this force lifts and moves the utensil 3 on a cooking surface of top plate 2 if the utensil 3 is not heavy enough. A phenomenon of this kind tends to occur rather notably when utensil 3 is made of aluminum of which a specific gravity is smaller than copper.

FIG. 5A is a schematic illustration showing a direction of electric current 4A flowing in coil 4, as observed from the side of utensil 3, and FIG. 5B is a schematic illustration showing a direction of eddy current 3A induced in utensil 3 by the electric current that flows in coil 4, as observed from the same direction as that of FIG. 5A. Eddy current 3A flows generally in the same circular pattern as electric current 4A of coil 4, but in the opposite direction, as shown in FIG. 5A and FIG. 5B. Therefore, these two circularly flowing currents resemble a pair of magnets having substantially same sectional area as the size of coil 4, disposed in a manner that same magnetic poles confront each other, namely N-pole against N-pole, for instance. As a result, utensil 3 and coil 4 produce a large repulsive force between them.

This phenomenon is very noticeable when utensil 3 is made of a material of high specific conductivity such as aluminum and copper. On the other hand, a utensil made of non-magnetic stainless steel generates a sufficient amount of heat even when the electric current supplied to coil 4 is small, because a specific conductivity of stainless steel is lower than aluminum and copper although it is a material of similarly low magnetic permeability. For this reason, coil 4 generates a weak magnetic field and induces a small eddy current to flow in utensil 3, thereby exerting a small lifting force on utensil 3 being heated.

As described above, there is the possibility that utensil 3 made of aluminum floats in the air and it is not heated properly due to the lifting force exerted on utensil 3 when used for cooking on the induction cooking stove. As a measure to resolve this phenomenon, Japanese Patent Unexamined Publication, No. 2003-264054 discloses a structure in which electric conductor 7 is provided between coil 4 and top plate 2 in a manner to be in close contact to top plate 2, as shown in FIG. 4. In this structure, magnetic field generated by coil 4 crosses both electric conductor 7 and utensil 3, and produces an induction current in both of them. In this case, an interaction between magnetic field generated by the induction current induced in electric conductor 7 and magnetic field generated by the induction current induced in utensil 3 converges the magnetic flux of coil 4 into the center area, which increases an equivalent series resistance of coil 4. This increase in the equivalent series resistance means a strong magnetic coupling between utensil 3 and coil 4. When the magnetic coupling becomes strong, coil 4 can generate an equivalent amount of heat in utensil 3 with a small electric current, and decrease the lifting force. This effect of decreasing the lifting force becomes greater the more the equivalent series resistance of coil 4 is increased by expanding a surface area of electric conductor 7 confronting coil 4. Here, the equivalent series resistance is defined as an equivalent series resistance in an input impedance of coil 4 as measured with a frequency approximating the heating frequency under the condition in which utensil 3 and electric conductor 7 are arranged in the same manner as the normal heating operation.

Since the adoption of electric conductor 7 decreases the lifting force as described above, it makes cooking practically possible by induction-heating utensil 3 made of a material having a high electric conductivity and low magnetic permeability such as aluminum.

However, it is necessary to control a total weight of utensil 3, or the pan, and food material so that they become heavier than a prescribed weight because the floating phenomenon of utensil 3 can not be completely disregarded in the actual use.

To solve this problem, it is considered practical to reduce the lifting force exerted on utensil 3 by increasing the surface area of electric conductor 7. In other words, there is the need to increase the equivalent series resistance of coil 4. To be specific, it is considered effective to reduce the aperture in the center of electric conductor 7 confronting coil 4 to such a dimension that leaves only a space necessary for temperature detector 8 mounted to top plate 2 for detection of its temperature. This can thus increase the surface area of electric conductor 7 and reduce the lifting force.

On the other hand, the reality is that not many pans have perfectly flat bottoms, but they normally have slightly warped bottoms. That is, the majority of pans used are inwardly warped in the bottom into a concaved shape.

However, when any of such warped pans is used for heating on the induction stove provided with electric conductor 7, the bottom of the pan stays far from coil 4. This decreases an amount of magnetic flux crossing the pan in an area corresponding to the center of coil 4, and increases the magnetic flux that crosses electric conductor 7, thereby resulting in an increase in the amount of heat generated in the inner part of electric conductor 7. This gives an extraordinary rapid rise in temperature of electric conductor 7 in an area near the center thereof. In addition, the heat generated in electric conductor 7 is prevented from being conducted to the bottom of the pan due to a void space between the warped portion of the pan bottom and top plate 2, and this further accelerates the temperature rise of electric conductor 7. It is also necessary to reduce an output power of coil 4 when the temperature of electric conductor 7 becomes too high, in order to suppress the heating of electric conductor 7 and to prevent the high temperature of electric conductor 7 from causing an adverse influence to coil 4 and the like components. This can be achieved by means of monitoring the temperature of electric conductor 7, for instance, so as to interrupt or regulate the heating output when the monitored temperature becomes too high. As a result, there may be a case that it takes too much time for cooking, or the cooking is not completed because the output of coil 4 is reduced prematurely if the temperature of electric conductor 7 rises so rapidly. For this reason, electric conductor 7 must be provided with a void area of a predetermined diameter in the center thereof, and this makes it difficult to decrease the lifting force.

There are also other kinds of electric conductors similar to the invention of this application, such as those disclosed in Japanese Patent Unexamined Publications, Nos. H07-249480, H07-211443 and H07-211444. However, none of the induction heating apparatuses disclosed in these inventions is provided with a heating coil capable of heating utensils made of aluminum, copper and the like materials having generally equivalent or higher specific conductivities as those. In other words, the electric conductors disclosed in these patent publications hardly show any effect of decreasing the lifting force when induction-heating utensils made of materials having comparatively high specific resistances such as magnetic iron and stainless steel.

SUMMARY OF THE INVENTION

An induction heating apparatus of the present invention has a heating coil and an electric conductor. The heating coil is capable of induction-heating any utensil made of aluminum, copper and the like material having generally an equivalent or higher specific conductivity. The electric conductor is disposed between the heating coil and a utensil to be heated, and decreases a lifting force exerted on the utensil by a magnetic field generated by the heating coil. This electric conductor is disposed in a confronting manner to the heating coil, and it has an aperture in an area facing the center part of the heating coil and a slot which opens into this aperture and is isolated from an outer perimeter of the electric conductor. This structure increases the effect of the electric conductor to decrease the lifting force and improves a heating efficiency of the apparatus while preventing the electric conductor from generating excessive heat.

DETAILED DESCRIPTION OF PREFERRED EMBODIMENT

Figure 1:
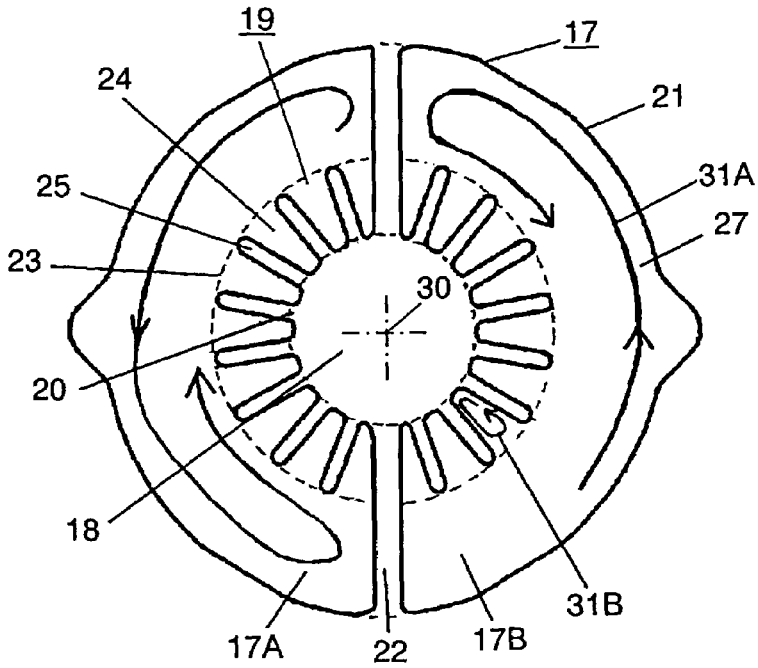
FIG. 1 is a plan view of an electric conductor in an induction heating apparatus according to an exemplary embodiment of this invention.
Figure 2:
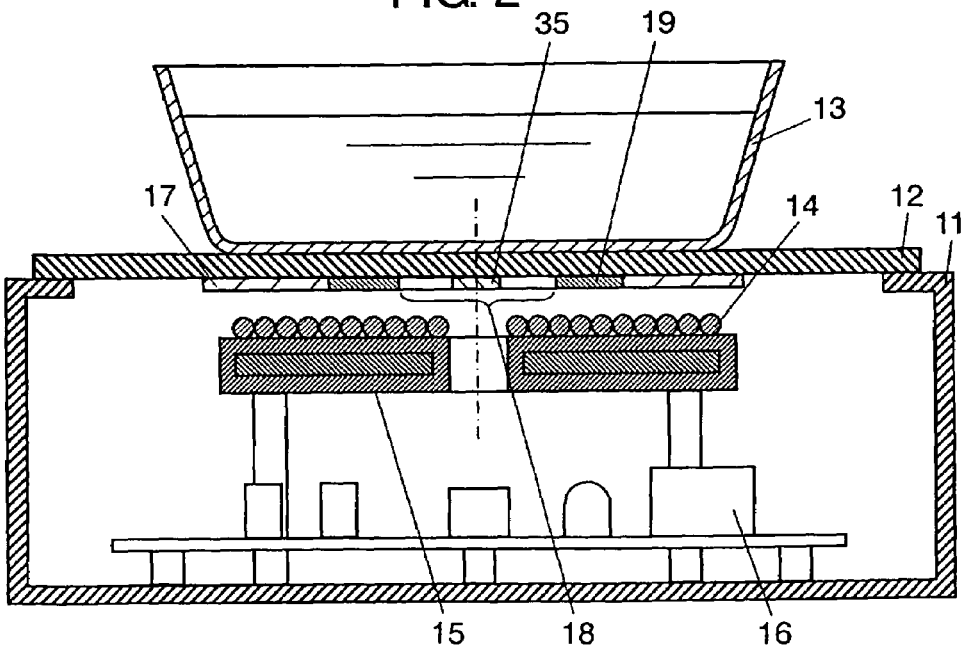
FIG. 2 is a cross sectional view of the induction heating apparatus according to the exemplary embodiment of this invention.

FIG. 1 is a plan view of an electric conductor in an induction heating apparatus according to an exemplary embodiment of this invention, and FIG. 2 is a cross sectional view of the same induction heating apparatus. Top plate 12 is mounted to an upper part of main body 11 that serves as an enclosure of the induction heating apparatus. Top plate 12 is constructed of an insulating material such as ceramic and crystallized glass having a thickness of 4 mm, for instance. Utensil 13 to be heated such as a pan is placed on top plate 12. Utensil 13 is made of a material of high electrical conductivity and low magnetic permeability such as aluminum, aluminum alloy, copper, copper alloy, and the like.

Induction heating unit 15 including heating coil (hereinafter referred to as "coil") 14 is provided underneath top plate 12. Driving circuit 16 having an inverter supplies a high-frequency current of 40 kHz to 100 kHz to coil 14, which in turn generates high-frequency magnetic field to heat the bottom of utensil 13 by magnetic induction. Electric conductor 17 for decreasing a lifting force exerted on utensil 13 by the magnetic field generated by coil 14 has an annular shape with aperture 18 in the center. It is also provided with comb sections 19 around the perimeter of aperture 18. That is, aperture 18 is formed in a manner to confront the center part of coil 14. Electric conductor 17 is secured adhesively or mechanically to an underside surface of top plate 12 in a position confronting coil 14. That is, electric conductor 17 is placed between coil 14 and top plate 12. In other words, electric conductor 17 is located between coil 14 and utensil 13 in the position confronting coil 14. Temperature sensor 35 is fixed to the underside surface of top plate 12 in a space within aperture 18 of electric conductor 17, and it detects a temperature of top plate 12 or utensil 13 being heated.

Description is provided hereinafter of electric conductor 17 representing a distinctive feature of this exemplary embodiment. Electric conductor 17 is constructed of a similar material as utensil 13, having high electrical conductivity and low magnetic permeability such as aluminum, aluminum alloy, copper, copper alloy and carbon. In other words, electric conductor 17 has a specific electric conductivity equal to or higher than any of aluminum and copper, and a magnetic permeability equal to or lower than any of them. In this structure, aluminum having a thickness of 1 mm is used. This is for the following reasons.

The thickness required for electric conductor 17 to shield the magnetic flux of coil 14 is at least equal to a penetrating depth "δ" of the magnetic flux. In the case of this structure in which the material used is aluminum and the current flowing in coil 14 is 70 kHz in frequency, the penetrating depth "δ" is approximately 0.3 mm. Therefore, a current is not induced in the other side of electric conductor 17, and this enhances an effect of decreasing the lifting force when electric conductor 17 is made to have a thickness equal to or more than the penetrating depth. It has been confirmed through an experiment that electric conductor 17 can provide a sufficient effect of decreasing the lifting force when it has a thickness of about 1 mm which is slightly more than the penetrating depth. In theory, therefore, electric conductor 17 simply needs to have a larger thickness than the penetrating depth of the high-frequency current used for the heating.

In FIG. 1, annularly shaped electric conductor 17 has two slits 22 cut from aperture 18 or inner perimeter 20 to outer perimeter 21 of the annular part in positions symmetrical to each other. In other words, two conductor segments 17A and 17B having an equally divided annular shape are arranged symmetrically to compose annular-shaped electric conductor 17. In FIG. 1, inner perimeter 20 is shown by a dotted line to make it intelligible. Electric conductor 17 is so placed that center 30 is generally coaxial to the center of coil 14.

Electric conductor 17 has comb sections 19 and belt-like sections 27. Belt-like sections 27 cover coil 14 along generally a winding pattern of coil 14, and it decreases the lifting force exerted on utensil 13 being heated. Comb sections 19 occupy an area inside the dotted lines. That is, comb sections 19 are formed in the area encircled between inner perimeter 20 and outer perimeter 23 of the comb sections 19. Comb sections 19 have comb teeth 24 formed in a manner to protrude from belt-like sections 27 toward the center of coil 14 with slots 25 formed between the respective adjoining comb teeth 24. Here, comb sections 19 have comb-like concavo-convex portions, or comb teeth 24 and slots 25 opened to inner perimeter 20 and separated from outer perimeter 21. Slots 25 are formed in a radially extending configuration from center 30 of annular conductor 17. Comb sections 19 provide an additional effect of decreasing the lifting force to that of belt-like sections 27, so as to further increase the effect of decreasing the lifting force.

The induction heating apparatus as constructed above operates and functions in a manner which is described hereinafter.

When utensil 13 to be heated is put on top plate 12 and the power supply is turned on, induction heating of utensil 13 begins by magnetic flux from coil 14. At this time, the magnetic flux from coil 14 crosses electric conductor 17, and induces eddy currents within electric conductor 17. Because the eddy currents flow in opposite directions with respect to each other in the adjoining area, they cancel each other out, and they virtually become circling current 31A that flows around belt-like sections 27 composed of conductor segments 17A and 17B. In this exemplary embodiment, since electric conductor 17 is provided with comb sections 19 throughout the inner side thereof, the circling current 31A averts comb sections 19 and flows along outer perimeter 23. The reason of this is considered to be the fact that electric conductor 17 shows a lower resistance when circling current 31A flows linearly rather than detouring through comb teeth 24, thereby making the current 31A flow more easy. Therefore, this structure of comb sections 19 having comb teeth 24 arranged alternately with slots 25 can positively prevent the circling current from flowing in the vicinity of aperture 18 of electric conductor 17. In this structure, it is necessary to reduce widths of comb teeth 24 because circling current 31A makes a detouring flow when their width is too large, as will be described later. Besides, although there occurs similarly circling current 31B that flows around in each of comb teeth 24 of comb sections 19, this eddy current does not produce a large amount of heat since only a small portion of the magnetic flux crosses each of these narrowly shaped teeth 24 and the eddy current induced therein is therefore very small. Accordingly, an amount of heat produced in comb sections 19 due to the induced currents depends mainly on the heat produced by circling current 31B. In other words, a temperature rise in these sections can be reduced substantially as compared to the case in which comb sections 19 are not provided. Slots 25 can thus suppresses the amount of heat attributable to the induced currents generated in the vicinity of aperture 18.

In comb sections 19, amount of the generated heat is reduced substantially as described above. Moreover, the magnetic flux of coil 14 is concentrated into the center area of coil 14 due to the effect of comb teeth 24 in comb sections 19, and this is equivalent to an increase in magnetic coupling between utensil 13 and coil 14. This results in an increase of the equivalent series resistance as well as the effect of decreasing the lifting force.

Description is provided hereinafter of a concrete example of the structure according to this exemplary embodiment. Electric conductor 17 is made of an aluminum plate of 1 mm thick having 180 mm in outer diameter and 60 mm in inner diameter, or the size of aperture 18, as shown in FIG. 1. Electric conductor 17 is also provided with two slits 22 of 10 mm wide cut through between the outer perimeter and the inner perimeter in locations symmetrical to each other. In other words, this structure has two sections of identically shaped electric conductors.

Figure 7:
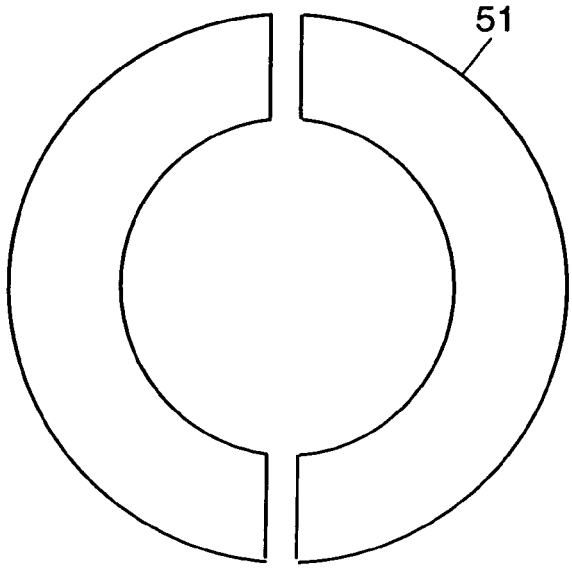
FIG. 7 ( PRIOR ART )

There are also comb sections 19 provided to decrease a temperature rise in the vicinity of inner perimeter 20. That is, comb-like concavo-convex portions are formed throughout inner perimeter 20 of electric conductor 17, or around aperture 18. FIG. 1 shows the structure provided with eight slots 25 and nine comb teeth (protruding portions) 24 in order to make them intelligible. If each of conductor segments 17A and 17B has forty slots 25 corresponding a number of recessed portions, there are forty-one teeth 24 corresponding to protruding portions, including two at both ends. Slots 25 are cut radially in 1 mm wide by 25 mm long into an annular configuration around the coaxial center of coil 14. In this configuration, the width of comb teeth 24 becomes larger the closer they become toward the outer perimeter. This structure is equivalent to electric conductor 51 shown in FIG. 7 provided with comb sections 19 in an area extending 25 mm toward the center from the inner perimeter of the belt-like sections (annular parts).

Figure 6:
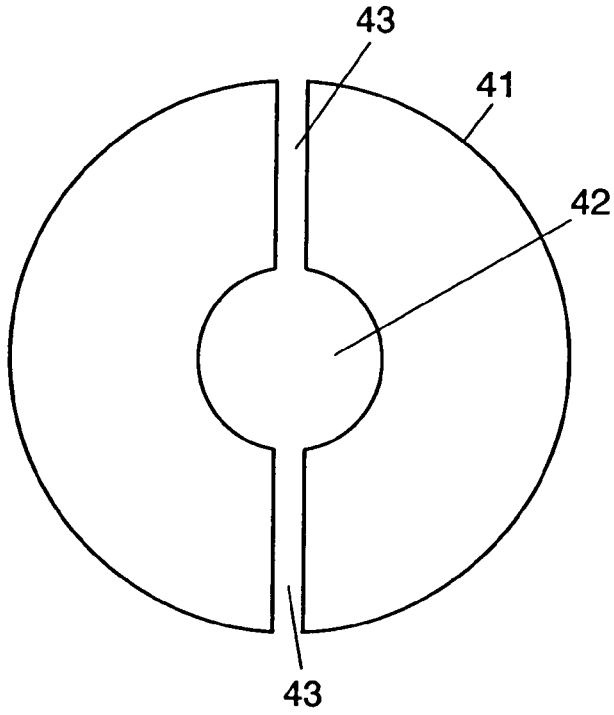
FIG. 6 ( PRIOR ART )
FIG. 6 and FIG. 7 are plan views of electric conductors used in the conventional induction heating apparatus.

Electric conductor 41 shown in FIG. 6 is similar to that of FIG. 1 except that it is not provided with comb sections 19. Electric conductor 41 is larger than electric conductor 51 by approx. 40% in surface area since electric conductor 51 measures 180 mm in the outer diameter and 110 mm in the inner diameter.

A comparison is made next, of a result of measurement for the equivalent series resistance of the heating coil taken on an induction heating apparatus equipped with electric conductor 41 by using a standard testing flat pan made of aluminum, as opposed to another result taken with electric conductor 51. Furthermore, a result of experiment will also be discussed on the apparatus adjusted to draw approx. 2 kW of input power and operated with the standard flat pan. The equivalent series resistance is 2.21Ω which is larger by about 21% as compared to 1.82Ω, and the lifting force was 340 g, a decrease of about 23% as compared to 440 g, demonstrating a great effect of decreasing the lifting force. A temperature rise of heating coil is 140 K, which is lower by 14 K than 154 K. A heating efficiency is also increased by about 2%.

In addition, a time for the inner perimeter of the electric conductor 41 to reach 350° C. is 96 seconds when measured under the same conditions as above with another standard aluminum testing pan having a concaved bottom, as compared to 220 seconds in the case of electric conductor 51. The fact that it takes a shorter time to reach 350° C. means faster temperature rise. Assume that the output power of the apparatus is controlled, for example, to maintain the temperature of electric conductor 41 or electric conductor 51 to a predetermined level or lower for the sake of safety. In this case, the apparatus equipped with electric conductor 41 takes a longer time to complete cooking as compared to the apparatus having electric conductor 51, since the former goes into the suppressing control to reduce power output of the heating coil in a shorter period of time, and thereby lowering the average heating power.

Next, a comparison is made between electric conductor 17 and electric conductor 41. Because electric conductor 17 has a smaller area than that of electric conductor 41 by portions taken by the slots, it is 10% less in the area, 5% less in the equivalent series resistance, and 15% larger in the lifting force as compared to electric conductor 41, indicating a slight decrease in the effect of reducing the lifting force. However, it takes 458 seconds for inner perimeter 20 of electric conductor 17 to reach the temperature of 350° C. when tested with the standard pan of concaved bottom, which is considerably longer than the result obtained with electric conductor 41. No significant changes are noted, however, in the heating efficiency and the temperature rise of the heating coil.

A comparison is also made between electric conductor 17 and electric conductor 51. Electric conductor 17 is approx. 25% larger in the area, approx. 15% larger in the equivalent series resistance, and 10% less in the lifting force as compared to electric conductor 51, indicating an increase in the effect of reducing the lifting force. In addition, it takes twice or longer as long a time for the inner perimeter of electric conductor 17 to reach the temperature of 350° C.

It is obvious through the above that the structure according to this exemplary embodiment can decrease the lifting force and suppress the temperature rise in the inner perimeter of electric conductor 17 as compared to the case of using electric conductor 51. Furthermore, this exemplary embodiment can also decrease substantially the temperature rise around aperture 18 although the effect of decreasing the lifting force is reduced slightly when compared to the case of using electric conductor 41. Therefore, it takes quite a long duration of time before of the electric conductor reaches a temperature, which requires power control, when the temperature is measured for the purpose of controlling the output power, for instance, to maintain the temperature below a predetermined level. In other words, it can continue the induction heating for a long duration with high heat. The embodied structure can thus shorten the cooking time, improve cooking performance, ease restrictions on use of deformed pans, and thereby improve the convenience of use.

In this exemplary embodiment, although what is illustrated is an example in which electric conductor 17 is provided with slits 22 in two locations, this invention shall not be considered limited to this structure, and that slits 22 may be omitted. When this is the case, the equivalent series resistance of coil 14 increases and so does the effect of decreasing the lifting force, since the surface area of electric conductor 17 increases by an area taken for slits 22. In addition, the single piece of electric conductor 17 makes it easy to handle in the manufacturing process. On the other hand, it should require an attention in designing electric conductor 17 since it allows a circling current to flow through the entire periphery thereof, thereby giving rise to a possibility of increasing an amount of the current and the heat it produces.

Alternatively, electric conductor 17 may be provided with one slit 22. In this case, the effect of decreasing the lifting force decreases slightly as compared to the case of no slit, although a less amount of the circling current alleviates the heat produced. In addition, it results in an uneven lifting force to act on utensil 13, since the effect of decreasing the lifting force becomes smaller in an area near slit 22 as opposed to the other area.

It is therefore desirable to provide two or more number of slits 22 in different locations as illustrated in this exemplary embodiment. These slits 22 divide and reduce the circling current, and decrease the resulting heat. It is also desirable that slits 22 are arranged in a symmetrical manner, so as to make the lifting force act evenly on utensil 13.

As discussed, the more the number of slits 22 provided in electric conductor 17 the less the surface area of it and a value of the equivalent series resistance. This consequently reduces the effect of decreasing the lifting force when compared with the cases of no slit and the less number of slits 22. There are both merits and demerits associated with increase and decrease in the number of slits, as mentioned above, and it is therefore necessary to take them into account in the designing.

In this exemplary embodiment, electric conductor 17 used is described as being an annular shape. The annular shape here means any shape that is substantially annular, and this includes the electric conductor 17 shown in FIG. 1 which has tabs on parts of the outer perimeter for the mounting purpose. It is desirable as described that electric conductor 17 is annularly shaped with its center generally in coaxial to coil 14, so that it can cover coil 14 evenly, to exert the lifting force uniformly on utensil 13 being heated.

In this exemplary embodiment, although electric conductor 17 is described as being 180 mm in the outer diameter, this should not be considered restrictive. Since induction heating apparatuses used in households in general have heating coils of about 180 mm in diameter as they correspond to sizes of the ordinary pans, it is appropriate for electric conductor 17 to be generally the corresponding size between 160 mm and 200 mm.

Though the inner diameter of electric conductor 17 changes depending on the outer diameter, it is practically suitable to keep 25 to 55% of the outer diameter, and 30 to 45% is even more suitable according to a result of study. The aperture of any such inner diameter reduces the lifting force effectively without impeding the mounting of temperature sensor 35 to top plate 12. Although electric conductor 17 is described as being the annular shape in this exemplary embodiment, this should not be considered restrictive. Rather, it can be of any other shape such as polygonal in both the inner perimeter and the outer perimeter. Shapes of the inner and outer perimeters of electric conductor 17 can be determined in consideration of other components in the vicinity thereof.

It is also necessary that comb sections 19 are designed not to let the circling currents in electric conductor 17 to flow into them, and to reduce eddy currents induced within them. To accomplish this, it is desirable to increase the overall area of slots 25 or the recessed portions, and to slim the width of individual teeth 24 or the protruding portions. This is because reduction of the areas of teeth 24 can suppress induction of the eddy current and reduce the amount of circling currents entering into teeth 24. It is practically desirable that individual teeth 24 have a width of 0.5 to 10 mm, and 1 to 6 mm is even more desirable according to a result of study. If teeth 24 are narrower than 0.5 mm, they impair the productivity. On the other hand, teeth 24 exceeding 10 mm wide cause the circling currents to flow into them and induce eddy currents inside the teeth 24 which increase the heat generated therein.

It is desirable practically that slots 25 between teeth 24 have 0.5 to 3 mm in width, and 1 to 2 mm is even more desirable according to a result of study. This is because slots 25, if narrower than 0.5 mm, are difficult to fabricate, and they reduce the surface area of comb sections 19 and decrease the equivalent series resistance if they exceed 3 mm. In this exemplary embodiment, although slots 25 are illustrated as having a uniform width, this should not be considered restrictive. Instead, teeth 24 may be parallel-sided with a uniform width, or formed into any other shape. Furthermore, identically-shaped teeth 24 and slots 25 need not be aligned at regular intervals like a comb, but they can be shaped differently and arranged irregularly. In the above exemplary embodiment, any of slots 25 and teeth 24 are arranged radially around the center of the annularly shaped electric conductor 17. The reason of this is to ease the fabrication of electric conductor 17 and to effectively decrease the lifting force. However, they need not be limited to this arrangement. Both slots 25 and teeth 24 may be arranged in any orientations if there is an opening inside inner perimeter 20.

Again, shapes of the protruding portions and the recessed portions formed in comb sections 19 are not considered limited to those described in this exemplary embodiment, but they can be formed into any configuration so long as they satisfy the essential object of this invention.

Although slits 22 are illustrated in this exemplary embodiment as being 10 mm in width, they should not be considered restrictive. Because slits 22 are cut open across outer perimeter 21 and aperture 18 of electric conductor 17, there induced a high voltage between conductor segments 17A and 17B at boundary sides of each slit 22 during the induction heating operation. The induced voltage is greater especially when there is only one slit 22. On the other hand, teeth 24 are short and they are connected with belt-like sections 27. Because of this structure, a voltage induced between adjoining teeth 24 across each slot 25 is smaller than the voltage induced across each slit 22 and spaces between teeth 24 can be maintained steadily. Therefore, it is feasible to form the width of slots 25 smaller than the width of slits 22. It is desirable to reduce the width of slots 25 close to the limit that does not give rise to a problem in the manufacturing and handling of the components, in order to increase the effect of decreasing the lifting force and the equivalent series resistance. Any or both of slits 22 and slots 25 may be filled with resin to keep their shapes invariable.

Although what is described in this exemplary embodiment is an example in that comb sections 19 are provided only around aperture 18, or inner perimeter 20 of the annulus ring, this is not restrictive. Even if additional comb sections are provided in other areas beside comb sections 19 around inner perimeter 20, comb sections 19 still have the same effect. Therefore, comb sections 19 can be provided in any particular areas other than these around inner perimeter 20, such as the outer perimeter or any part of is, for instance, comb sections 19 of this exemplary embodiment have the same effect of decreasing heat in these areas.

Moreover, electric conductor 17 needs not be in contact with top plate 12. For example, electric conductor 17 may be placed on coil 14 or a supporting member used for retaining coil 14. Electric conductor 17 can be retained with a space from top plate 12 in a manner as described, or abutted against top plate 12 via another insulating material. In those cases, however, the heat generated in electric conductor 17 is not dissipated efficiently by conduction through top plate 12.

Figure 3:
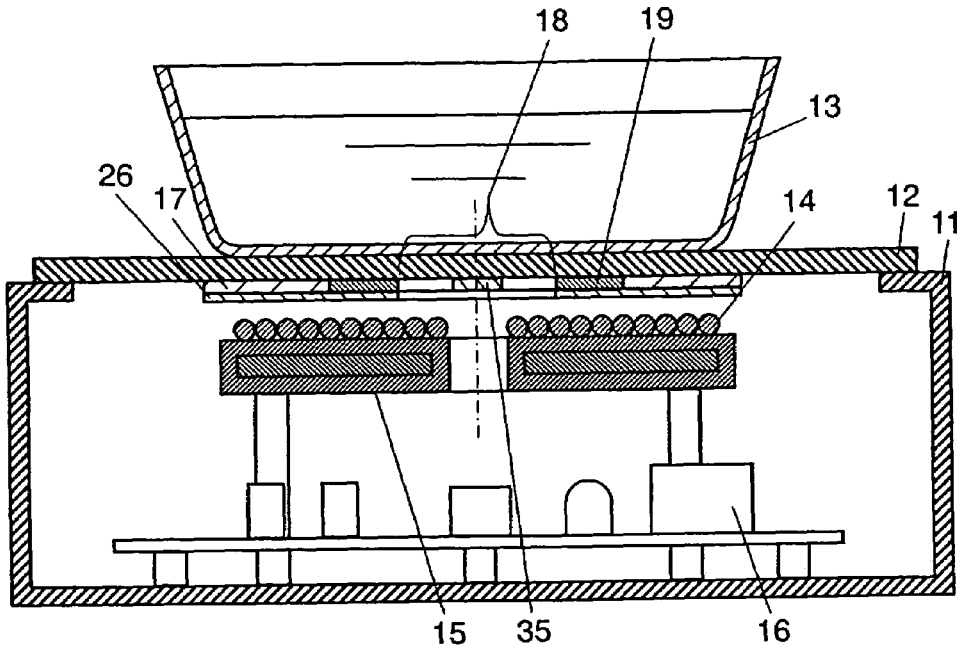
FIG. 3 is a cross sectional view of another induction heating apparatuses according to the exemplary embodiment of this invention.
Figure 4:
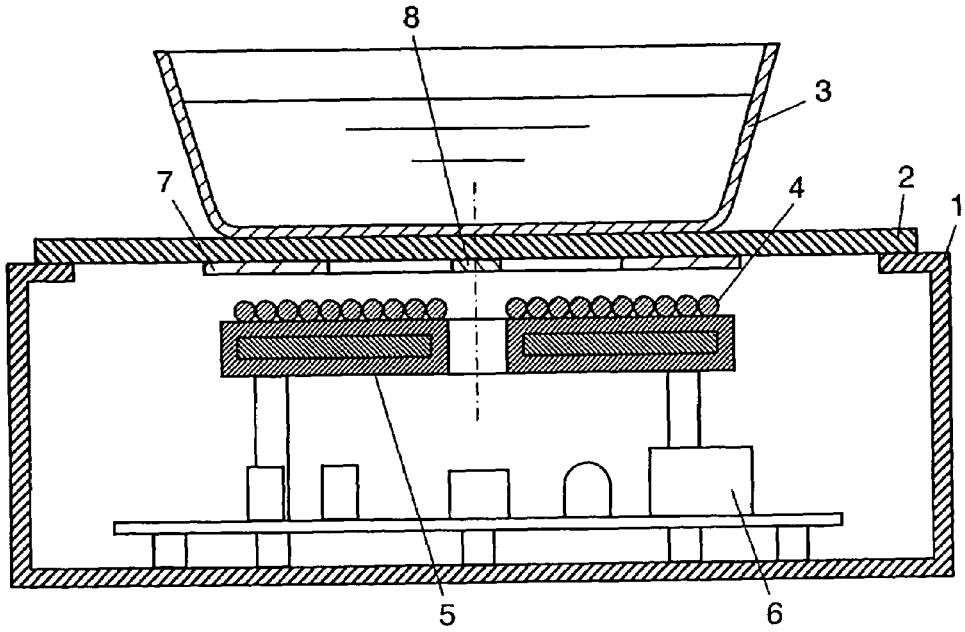
FIG. 4 ( PRIOR ART )
FIG. 4 is a cross sectional view of a conventional induction heating apparatus.
Figure 5A:
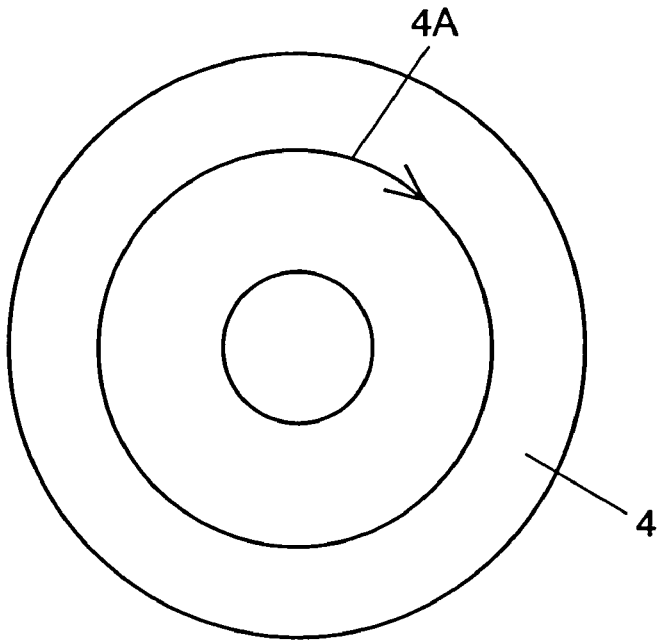
FIG. 5A ( PRIOR ART )
FIG. 5A is a schematic view illustrating an electric current flowing in a heating coil of the conventional induction heating apparatus.
Figure 5B:
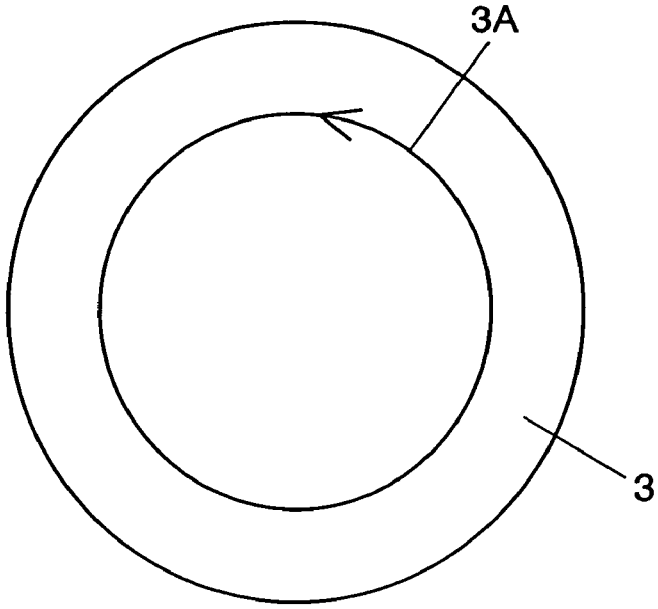
FIG. 5B ( PRIOR ART )
FIG. 5B is a schematic view illustrating an electric current flowing in a utensil being heated on the conventional induction heating apparatus.

Description is provided next of another structure according to this exemplary embodiment of the present invention. FIG. 3 is a cross sectional view of another induction heating apparatus in this exemplary embodiment of the invention. As shown here, it is more desirable to provide thermal insulator 26 between electric conductor 17 and coil 14. This insulator 26 reduces an amount of heat transferred from electric conductor 17 to coil 14. It therefore suppresses the temperature rise of coil 14, and improves reliability. In addition, it promotes the transfer of heat to utensil 13 by an amount prevented from being transferred to coil 14, thereby improving the heating efficiency. As a result, the above structure improves cooking performance as it shortens heating time.

Materials suitable for thermal insulator 26 are heat resistant type insulation materials of woven or unwoven fabric made of inorganic fibers such as glass and ceramic, mica insulator, and the like. Alternatively, any of the above materials may be used to confine air to use the air as a thermal insulator.

INDUSTRIAL APPLICABILITY

The present invention provides an induction heating apparatus featuring outstanding usability, since it alleviates lifting of a utensil being heated which tends to occur when the utensil is made of a material such as aluminum having a high conductivity and low magnetic permeability, and the apparatus can even allow use of a concaved pan having an inwardly warped bottom.

The invention claimed is:

1. An induction heating apparatus comprising:

a heating coil with capability of induction-heating a utensil made of any of aluminum, copper, and a low magnetically-permeable material having a specific electrical conductivity generally equal to or higher than aluminum and copper; and an electric conductor disposed confronting the heating coil, the electric conductor having an aperture in an area facing a center part of the heating coil and slots opening into the aperture but isolated from an outer perimeter thereof for reducing heat generated by an eddy current induced in the vicinity of the aperture to decrease a lifting force exerted on the utensil by a magnetic field generated by the heating coil when heating the utensil.

2. The induction heating apparatus according to claim 1, wherein the electric conductor has a comb section provided with comb teeth around the aperture sandwiching the slots.

3. The induction heating apparatus according to claim 2, wherein the electric conductor has at least one slit cut through between the outer perimeter and the aperture.

4. The induction heating apparatus according to claim 3, wherein a width of the slit is larger than a width of the slots.

5. The induction heating apparatus according to claim 3, wherein the electric conductor has a plurality of slits formed symmetrically.

6. The induction heating apparatus according to claim 3, wherein the electric conductor has an annular shape with a center of the electric conductor concentrically positioned with the center of the heating coil.

7. The induction heating apparatus according to claim 6, wherein the electric conductor of the annular shape has an outer diameter of at least 160 mm but at most 200 mm, and the aperture has an inner diameter sized at least 25% but at most 55% of the outer diameter.

8. The induction heating apparatus according to claim 7, wherein an inner diameter of the aperture is at least 30% but at most 45% of the outer diameter.

9. The induction heating apparatus according to claim 6, wherein a width of the teeth is at least 0.5 mm but at most 10 mm.

10. The induction heating apparatus according to claim 6, wherein a width of the teeth at least 1 mm but at most 6 mm.

11. The induction heating apparatus according to claim 6, wherein a width of the slots is at least 0.5mm but at most 3 mm.

12. The induction heating apparatus according to claim 6, wherein a width of the slots is at least 1 mm but at most 2 mm.

13. The induction heating apparatus according to claim 1, wherein the slots are formed radially around a center of the aperture.

14. The induction heating apparatus according to claim 1, further comprising a thermal insulator disposed between the electric conductor and the heating coil.

15. The induction heating apparatus according to claim 1, further comprising a main body serving an enclosure, and a top plate provided on an upper part of the main body for placing the utensil to be heated, wherein the heating coil is disposed underneath the top plate, and the electric conductor is disposed between the heating coil and the top plate.

* * * * *